US006932623B2

(12) United States Patent
Lai

(10) Patent No.: US 6,932,623 B2
(45) Date of Patent: Aug. 23, 2005

(54) CARD ADAPTER

(75) Inventor: Yaw-Huey Lai, Taipei Hsien (TW)

(73) Assignee: Tai-Sol Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 10/726,596

(22) Filed: Dec. 4, 2003

(65) Prior Publication Data

US 2005/0085130 A1 Apr. 21, 2005

(30) Foreign Application Priority Data

Oct. 21, 2003 (TW) ..... 92218718 U

(51) Int. Cl.[7] ..... H01R 12/00
(52) U.S. Cl. ..... 439/76.1; 439/630; 439/945
(58) Field of Search ..... 439/76.1, 638, 439/945, 946, 630; 361/737

(56) References Cited

U.S. PATENT DOCUMENTS 6,224,391 B1 * 5/2001 Horie et al. ..... 439/64

* cited by examiner

*Primary Examiner*—Phuong Dinh
(74) *Attorney, Agent, or Firm*—Bacon & Thomas

(57) ABSTRACT

A card adapter for accommodating a memory card and connecting an external device is composed of a frame member, two cover plates covered on the frame member, an internal frame disposed inside the frame member and having a plurality of terminals, a lateral section and a rear section that both define a reception space together with a front edge and a lateral edge of the frame member, two guide grooves respectively disposed on the lateral edge of the frame member and the lateral section of the internal frame, an adapting circuit board electrically connected with the terminals of the internal frame, and an terminal connector mounted at a rear end of the frame member and is connected with the adapting circuit board. Accordingly, the card adapter of the present invention is structurally simplified and low in production cost.

5 Claims, 8 Drawing Sheets

CARD ADAPTER

BACKGROUND OF THE INVENTION

1. Field of the Invention

The present invention relates generally to electronic devices, and more particularly to a card adapter for accommodating a memory card and connecting an external device.

2. Description of the Related Art

A conventional card connector is different from personal computers (PC) and other electronic devices in design, size, and interface, such that an adapter is required to interface between the card connector and other devices.

As shown in FIG. 8, when a card connector is connected to an adapter by a conventional way, the card connector 81 is put into the adapter 86, the card connector 81 is fixedly adhered or clamped into the adapter 86, an adapting circuit board 87 is connected with contact pins of the card connector 81, the contact pins of the card connector 81 are converted by the adapter 86, a control circuit 88 of the adapting circuit board 87 is used to accommodate a predetermined interface, and the converted contact pins of the card connector 81 are connected with a terminal connector 89 mounted at a rear end of the adapter 86 for further connecting different interfaces.

However, the aforementioned conventional arrangement includes some drawbacks. The card connector and the adapter have to be independent components and be connected with each other by electric wires. In other words, the card connector and the adapter are manufactured independently and are electrically connected to convert their contact pins. In addition, the card connector has to be secured inside the adapter by adhesives or clamping tools, substantially requiring four steps to complete the combination of the card connector and the adapter, such that the production process is too complex to reduce the production cost.

SUMMARY OF THE INVENTION

The primary objective of the present invention is to provide a card adapter that simplifies the structure of combination of the card connector and the card adapter to further simplify the production process.

The secondary objective of the present invention is to provide a card adapter in which production cost and production processing are lower and simpler than the prior art.

The foregoing objectives of the present invention are attained by the card adapter that is composed of a frame member, two cover plates, an internal frame, an adapting circuit board, and a terminal connector. The frame member includes an insertion slot at a front end thereof. The two cover plates are covered on the frame member. The internal frame is disposed inside the frame member and includes a plurality of terminals, a lateral section and a rear section that both define a reception space together with a front edge and a lateral edge of the frame member. Two guide grooves are respectively disposed on the lateral edge of the frame member and the lateral section of the internal frame. The adapting circuit board includes a plurality of electronic components formed as an adapting control circuit electrically connected with the terminals of the internal frame. The terminal connector is mounted at a rear end of the frame member and is connected with the adapting circuit board. Accordingly, the card adapter of the present invention is structurally simplified and low in production cost.

DETAILED DESCRIPTION OF THE INVENTION

Figure 1:
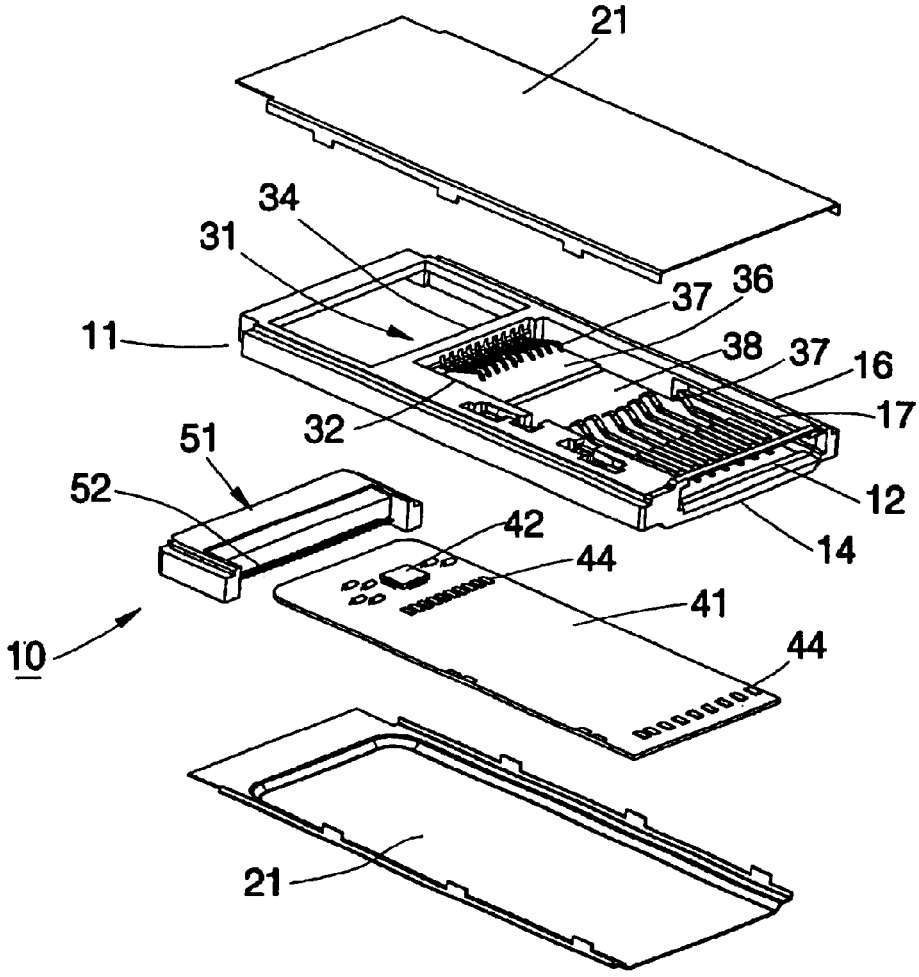
FIG. 1 is an exploded view of a first preferred embodiment of the present invention.

Referring to FIGS. 1–4, a card adapter 10 constructed according to a first preferred embodiment of the present invention is composed of a frame member 11, two cover plates 21, an internal frame 31, an adapting circuit board 41, and a terminal connector 51.

The frame member 11 includes an insertion slot 12 at a front end thereof.

The two cover plates 21 are respectively covered on a top side and a bottom side of the frame member 11.

The internal frame 31 is disposed inside and integrally formed with the frame member 11 and includes a lateral section 32 and a rear section 34, which both together with a front edge 14 and a lateral edge 16 of the frame member 11 define a reception space 38. Two guide grooves 17 and 33 are respectively disposed on the front edge 14 of the frame member 11 and the lateral section 32 of the internal frame 31. The insertion slot 12 of the frame member 11 is positioned at a front end of the reception space 38. The two guide grooves 17 and 33 are positioned at bilateral sides of the insertion slot 12. The internal frame 31 includes two terminal-fastening plates 36 extending therefrom towards the reception space 38 and having a plurality of terminals 37.

The adapting circuit board 41 includes a plurality of electronic components 42 defining an adapting control circuit, and a plurality of contact pads 44 electrically connected with the electronic components 42 and the terminals 37.

The terminal connector 51 is mounted to a rear end of the frame member 11 and includes a plurality of contact pins 52 connected with the adapting circuit board 41.

The reception space 38 defined by the frame member 11 and the internal frame 31 is provided for inserting and receiving a memory card. The terminals 37 are connected with the adapting circuit board 41 to convert contact pins of the memory card, thereby accommodating different interfaces. The internal frame 31 and the frame member 11 can be integrally formed once by plastic injection molding, thereby enhancing the structural stability and reducing the inaccuracy that may be incurred while two components are combined to further attain preferable precision of positioning other components.

Figure 2:
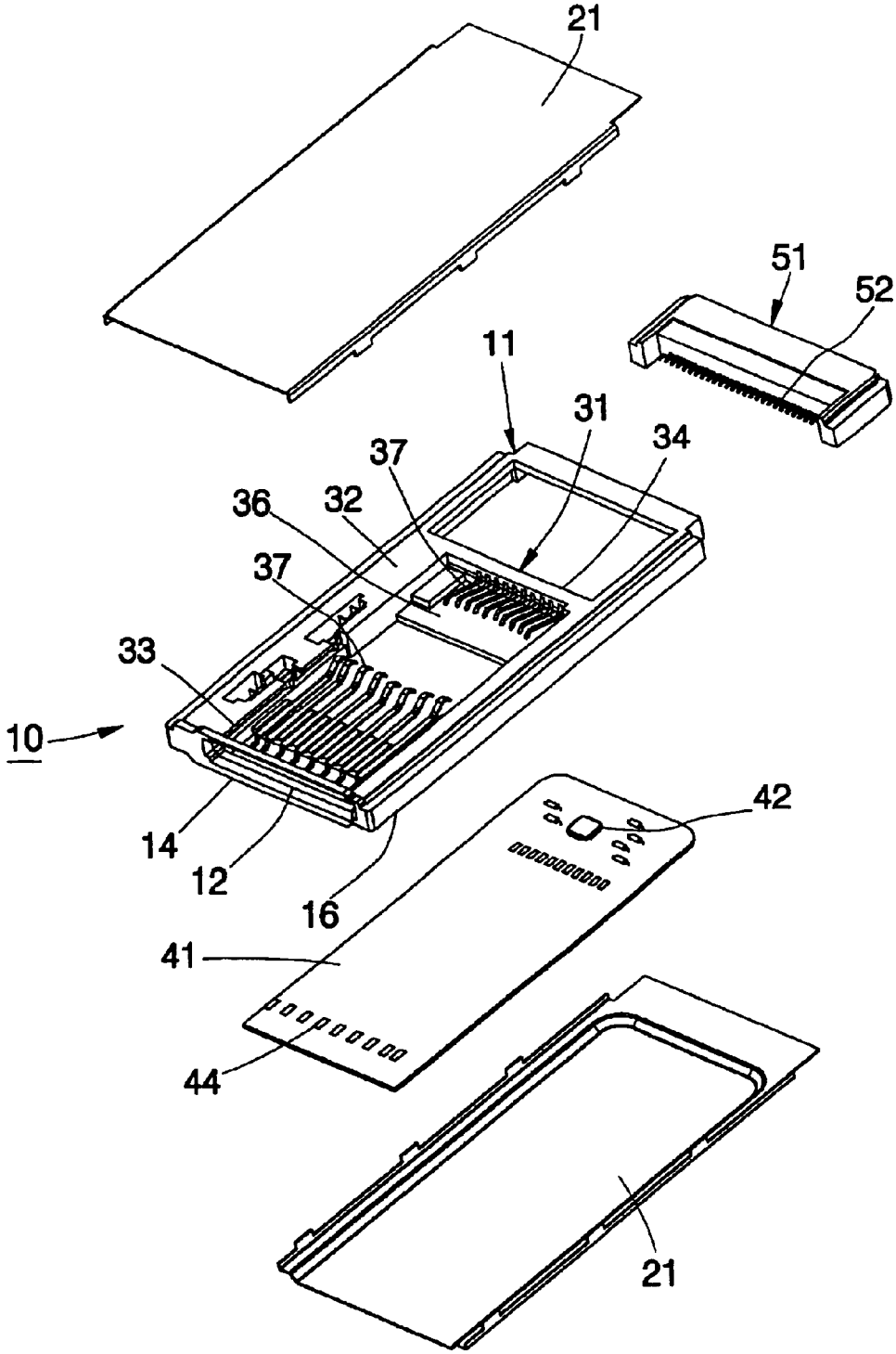
FIG. 2 is another exploded view taken from another angle in accordance with the first preferred embodiment of the present invention.
Figure 3:
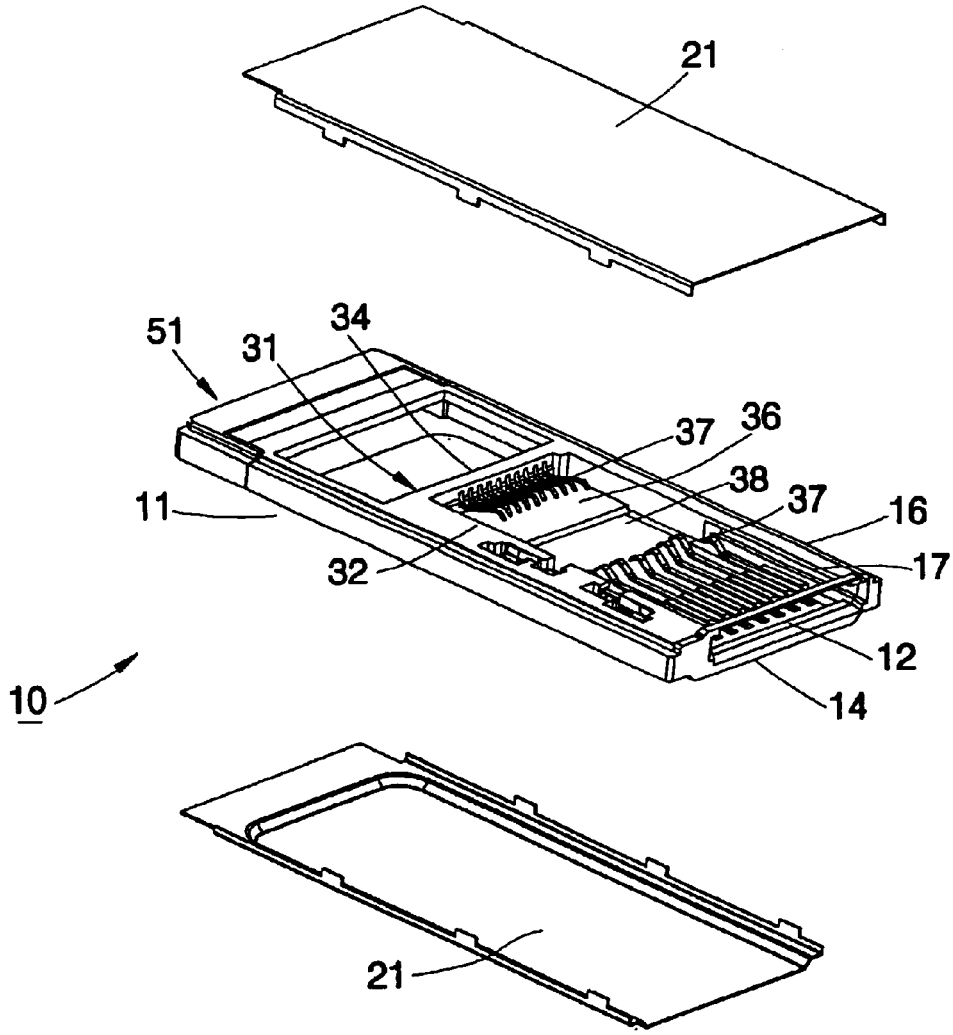
FIG. 3 is a perspective view of the first preferred embodiment of the present invention with two cover plates removed.
Figure 4:
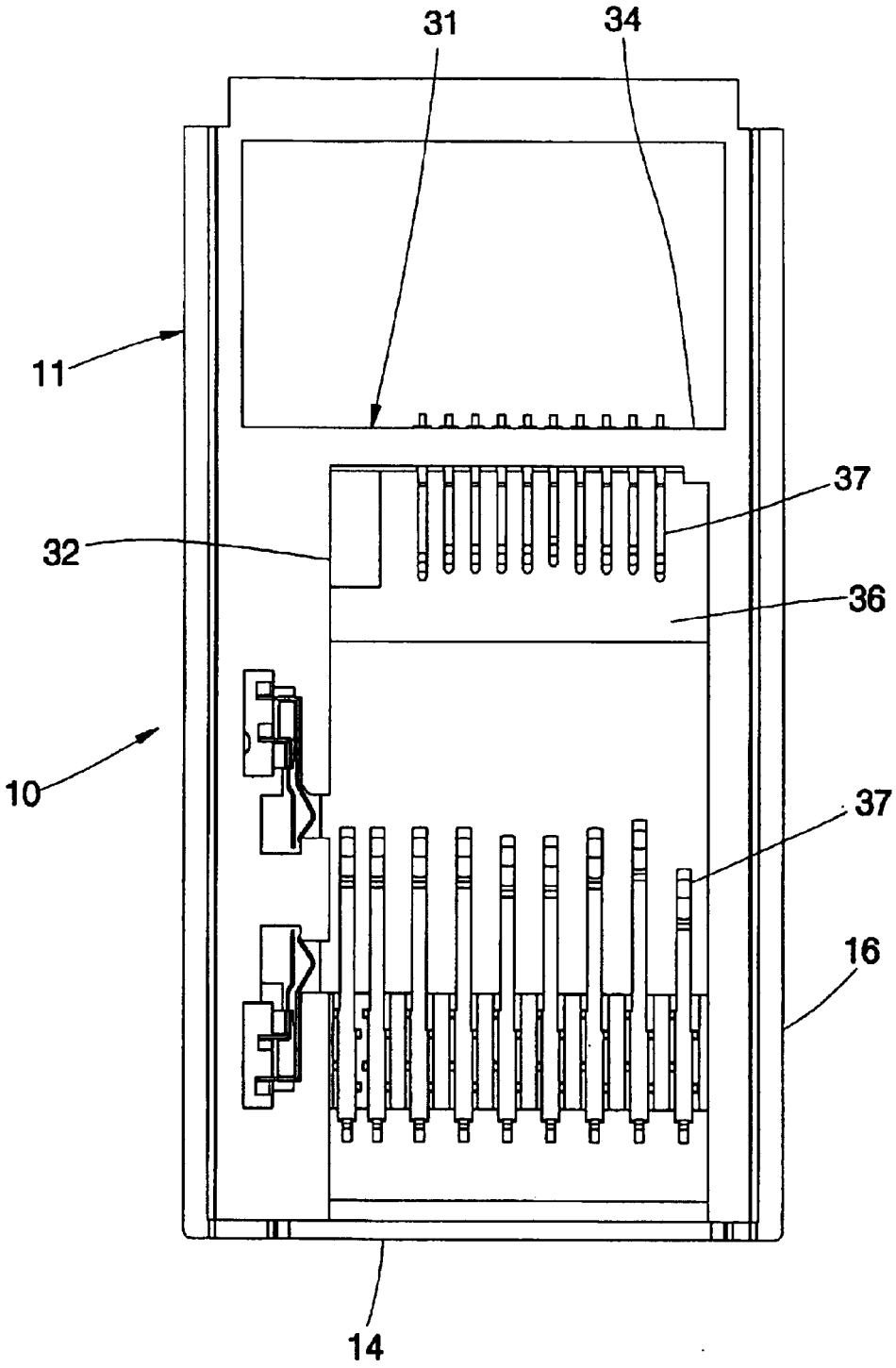
FIG. 4 is a top view at an enlarged scale in accordance with the first preferred embodiment of the present invention with the cover plates removed.
Figure 5:
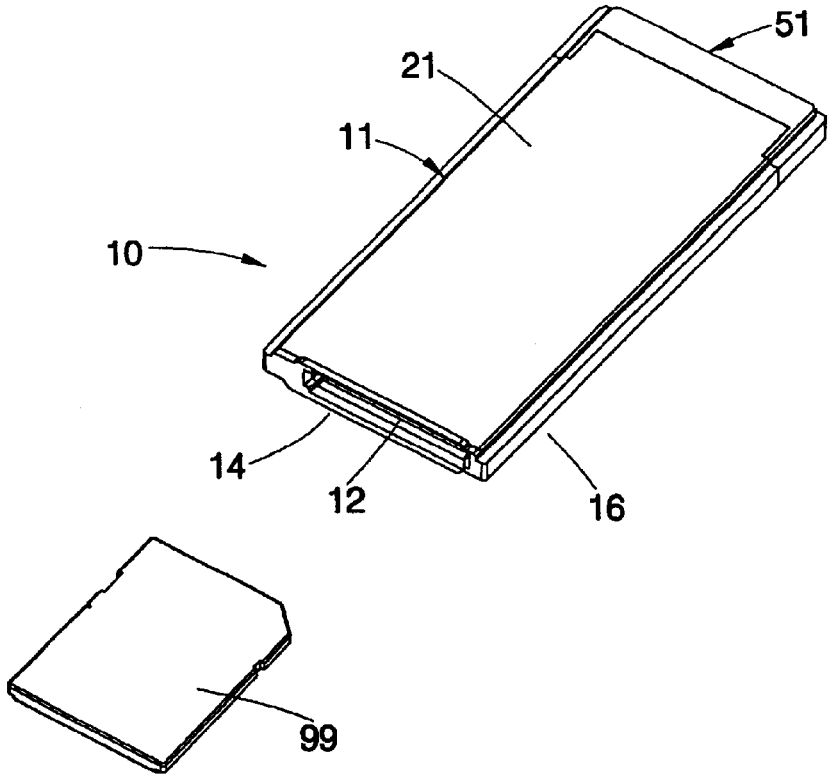
FIG. 5 is a schematic view of the first preferred embodiment of the present invention to be inserted with a memory card.

Referring to FIGS. 1, 2, and 5, when a memory card 99 is inserted into the card adapter 10, the memory card 99 is inserted through the insertion slot 12, along the guide grooves 17 and 33 of the lateral edge 16 and the lateral section 32, and then into the reception space 38, thereby enabling the terminals 37 to contact contact pins (not shown) of the memory card 99. When the card adapter 10 is not in use, it only needs to remove the memory card 99 from the card adapter 10.

Figure 6:
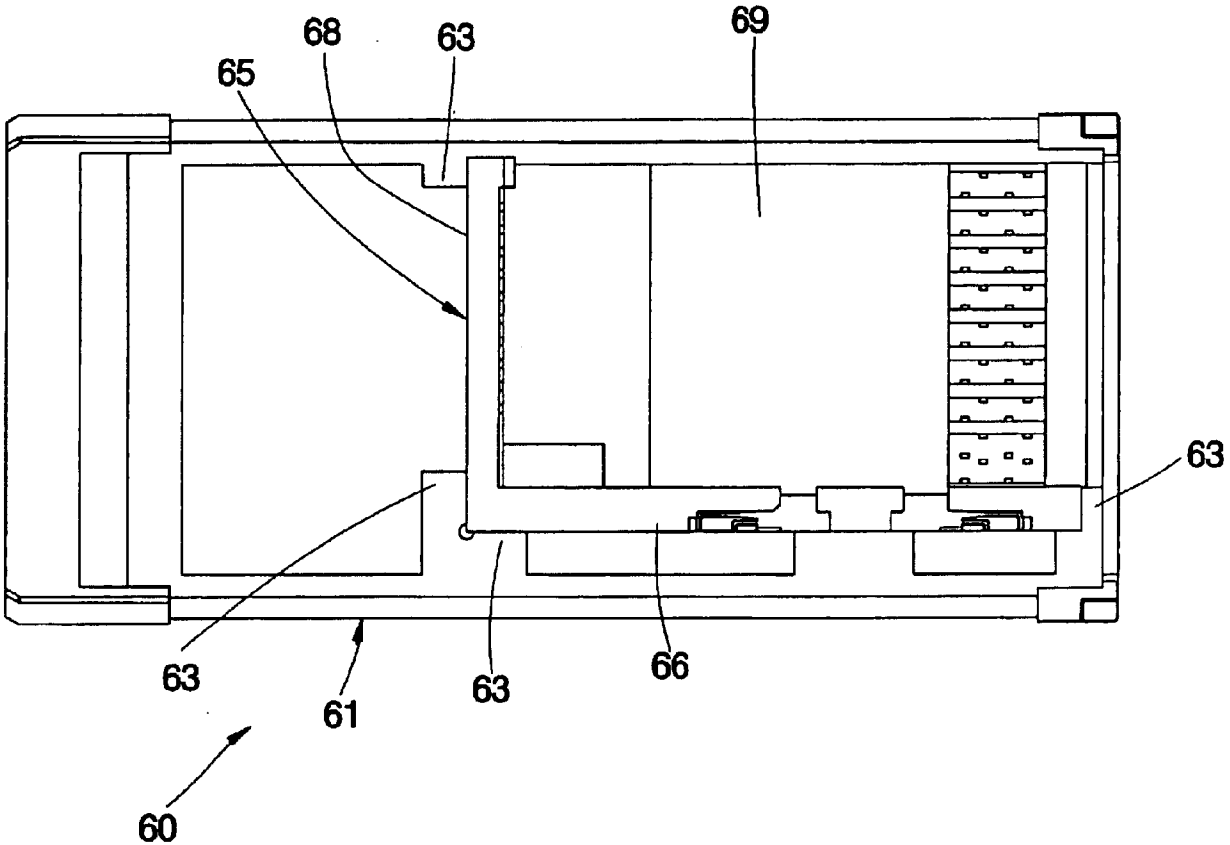
FIG. 6 is a top view at an enlarged scale in accordance with a second preferred embodiment of the present invention.

Referring to FIG. 6, the card adapter 60 constructed according to a second preferred embodiment of the present invention is different from the first preferred embodiment only by that the internal frame 65 and the frame member 61 are two independent components. The frame member 61 includes a plurality of retainers 63 extending inwards and corresponding to the lateral section 66 and the rear section 68 of the internal frame 65. When the internal frame 65 is positioned inside the frame member 61, the internal frame 65 is retained to be secured inside the frame member 61 by the retainers 63 and the reception space 69 is defined by the frame member 61 and the internal frame 65, thereby attaining the same objectives of the present invention.

Figure 7:
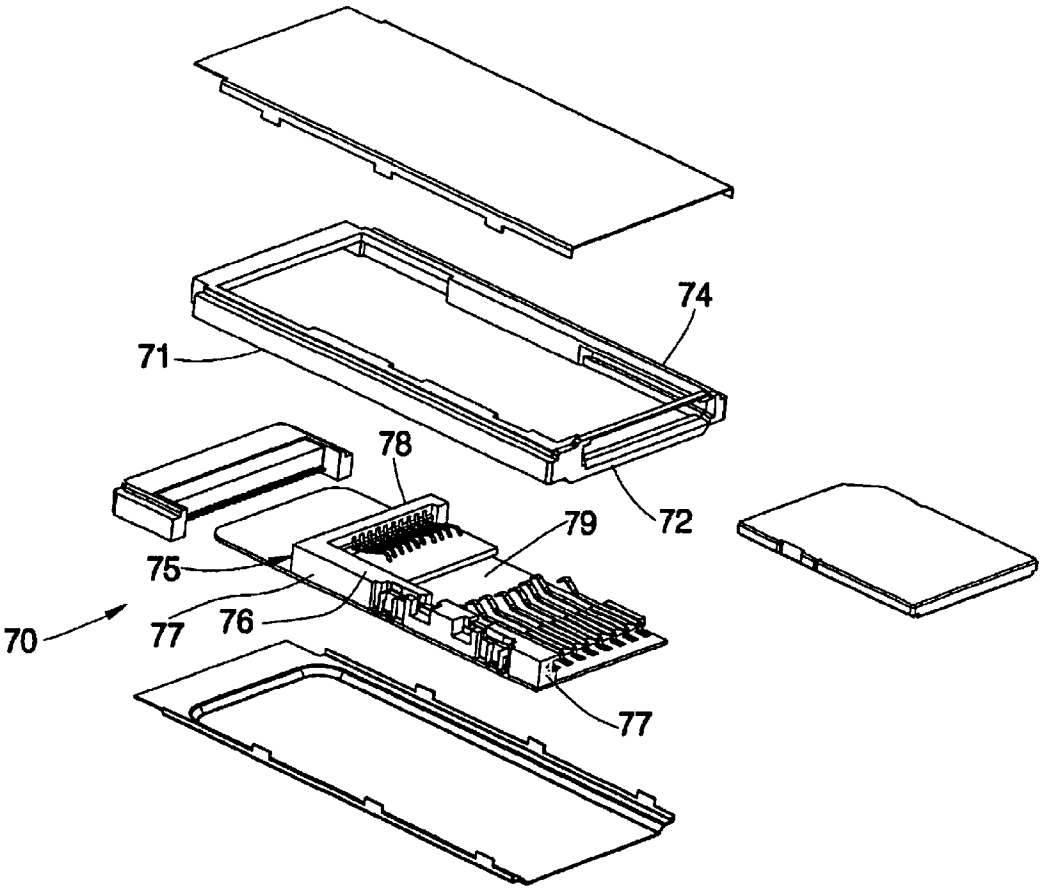
FIG. 7 is an exploded view of a third preferred embodiment of the present invention.
Figure 8:
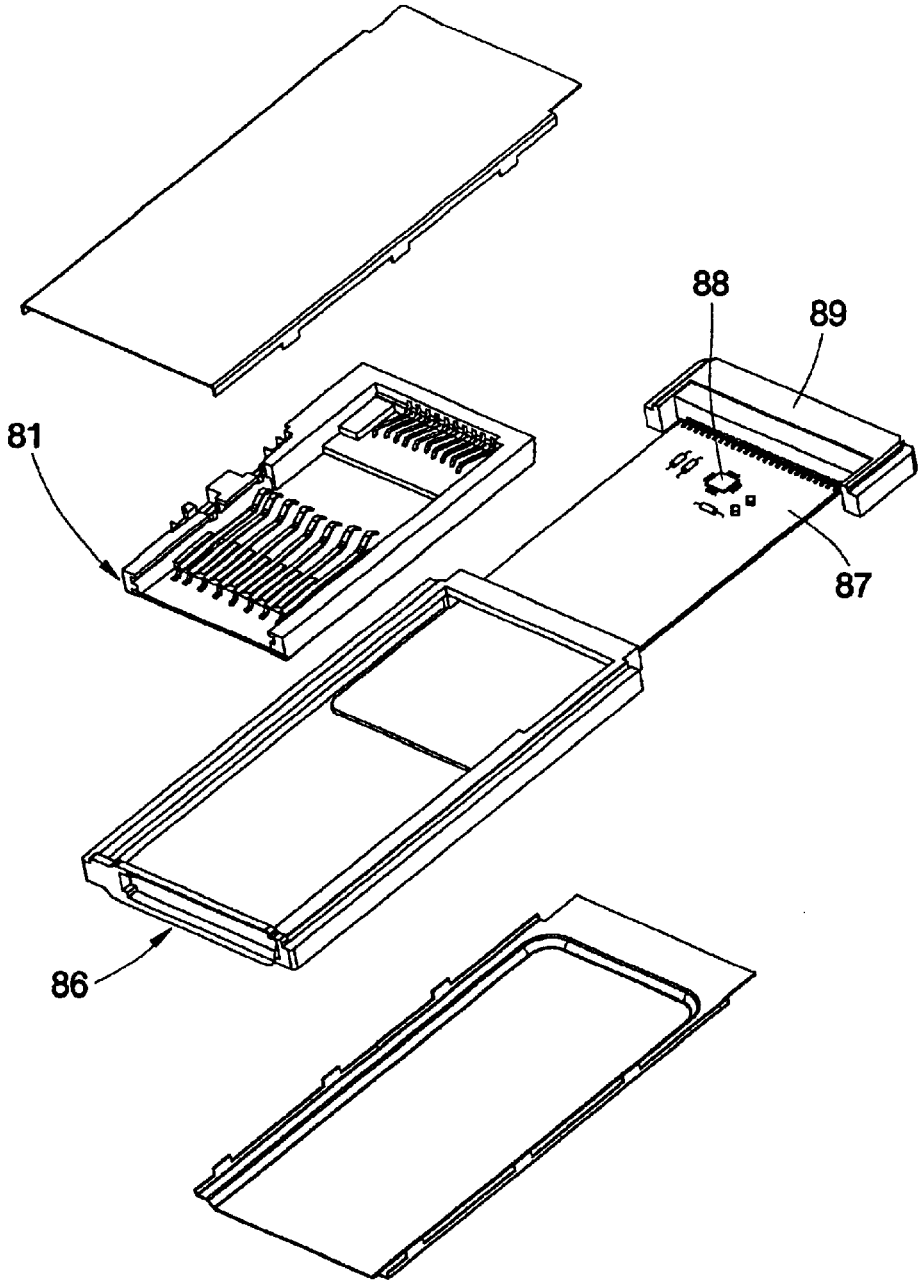
FIG. 8 PRIOR ART
FIG. 8 is a perspective view of a conventional adapter combined with a card connector.

Referring to FIG. 7, the card adapter 70 constructed according to a third preferred embodiment of the present invention is different from the aforementioned preferred embodiments only by that the internal frame 75 is L-shaped and is connected with the front edge 72 and the lateral edge 74 of the frame member 71 at distal ends of the lateral section 76 and the rear section 78 and an outer edge of the lateral section 76 by adhesives 77, and the reception space 79 is also defined by the frame member 71 and the internal frame 75, thereby attaining the same objectives of the present invention.

In conclusion, the present invention includes advantages as follows.

1. The lateral edge and the front edge of the frame member along with the internal frame together define the reception space of the card connector for receiving a memory card, thereby simplifying the structure of combining the card connector and the adapter to facilitate the production process of the card adapter of the present invention.

2. The card connector and the adapter are integrally formed to be structurally simplified, such the production process is simplified to further reduce the production cost and time.

What is claimed is:

1. A card adapter for accommodating a memory card and connecting an external device, said card adapter comprising:

a frame member having an insertion slot at a front end thereof;

two cover plates respectively mounted on a top side and a bottom side of said frame member;

an internal frame mounted inside said frame member and having a lateral section and a rear section, a reception space being defined by said lateral section and said rear section of said internal frame together with a front edge and a lateral edge of said frame member, two guide grooves being disposed respectively on the lateral edge of said frame member and the lateral section of said internal frame, said insertion slot being positioned at a front end of said reception space, said two guide grooves being positioned at bilateral sides of said reception space, said internal frame having at least one terminal-fastening plate extending therefrom towards said reception space, said terminal-fastening plate having a plurality of terminals;

an adapting circuit board having a plurality of electronic components and contact pads, said electronic components defining an adapting control circuit, said contact pads being electrically connected with said electronic components and said terminals; and a terminal connector mounted to a rear end of said frame member and having a plurality of contact pins connected with said adapting circuit board.

2. The card adapter as defined in claim 1, wherein said frame member further comprises a plurality of retainers extending inwards and positioned corresponding to said rear section and said lateral section of said internal frame; said internal frame is retained by said retainers to be secured inside said frame member while positioned inside said frame member.

3. The card adapter as defined in claim 1, wherein said internal frame and said frame member are connected together by adhesives.

4. A card adapter for accommodating a memory card and connecting an external device, said card adapter comprising:

a frame member having an insertion slot at a front end thereof;

two cover plates respectively mounted on a top side and a bottom side of said frame member;

an internal frame mounted inside said frame member and having a lateral section and a rear section, a reception space being defined by said lateral section and said rear section of said internal frame together with a front edge and a lateral edge of said frame member, two guide grooves being disposed respectively on the lateral edge of said frame member and the lateral section of said internal frame, said insertion slot being positioned at a front end of said reception space, said two guide grooves being positioned at bilateral sides of said reception space, said internal frame having at least one terminal-fastening plate extending therefrom towards said reception space, said terminal-fastening plate having a plurality of terminals;

an adapting circuit board having a plurality of electronic components and contact pads, said electronic components defining an adapting control circuit, said contact pads being electrically connected with said electronic components and said terminals; and a terminal connector mounted to a rear end of said frame member and having a plurality of contact pins connected with said adapting circuit board, wherein said internal frame and said frame member are integrally formed.

5. The card adapter as defined in claim 4 which is integrally formed plastic.

* * * * *